US008424872B2

(12) United States Patent
Iwakawa

(10) Patent No.: US 8,424,872 B2
(45) Date of Patent: Apr. 23, 2013

(54) SHEET CONVEYING APPARATUS AND IMAGE FORMING APPARATUS

(75) Inventor: Tadashi Iwakawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/608,224

(22) Filed: Oct. 29, 2009

(65) Prior Publication Data

US 2010/0109229 A1 May 6, 2010

(30) Foreign Application Priority Data

Nov. 6, 2008 (JP) ..... 2008-285470

(51) Int. Cl.
*B65H 9/04* (2006.01)

(52) U.S. Cl.
USPC ..... 271/242; 271/227; 271/228

(58) Field of Classification Search ..... 271/226–228, 271/242
See application file for complete search history.

(56) References Cited

U.S. PATENT DOCUMENTS 5,222,728 A * 6/1993 Takahashi ..... 271/242
5,738,349 A * 4/1998 Shirasaki ..... 271/242
5,933,697 A * 8/1999 Onodera et al. ..... 399/406
5,967,506 A * 10/1999 Miki et al. ..... 271/10.13
6,263,186 B1 * 7/2001 Okamoto et al. ..... 399/388
7,819,399 B2 * 10/2010 Choi ..... 271/228
2006/0214365 A1 * 9/2006 Yasui et al. ..... 271/242

FOREIGN PATENT DOCUMENTS

JP 62-244846 10/1987
JP 6-127753 5/1994
JP 10-152244 6/1998
JP 2001-247233 A 9/2011

* cited by examiner

*Primary Examiner* — Kaitlin Joerger
(74) *Attorney, Agent, or Firm* — Fitzpatrick, Cella, Harper & Scinto

(57) ABSTRACT

A sheet conveying apparatus in which a sheet is abutted on a stopped registration roller to correct skew feeding, including: a sheet detecting portion, a first stepping motor and a second stepping motor. The conveying roller is controlled to tentatively stop the sheet, the conveying roller is driven prior to the start of the drive of the registration roller, the registration roller is driven after a loop of a predetermined amount is formed in the sheet, the conveying roller is driven at a sheet conveying speed that is equal to or lower than a sheet conveying speed of a self-start frequency when the conveying roller forms the loop in the sheet, rotation of the first stepping motor being able to be started at the self-start frequency, and acceleration of the registration roller and acceleration of the conveying roller are started after the loop of the predetermined amount is formed.

9 Claims, 6 Drawing Sheets

TIME CHART OF SHEET CONVEYING SEQUENCE ACCORDING TO PRESENT APPARATUS

SHEET CONVEYING APPARATUS AND IMAGE FORMING APPARATUS

BACKGROUND OF THE INVENTION

1. Field of the Invention

The present invention relates to a sheet conveying apparatus and an image forming apparatus, particularly to the sheet conveying apparatus and image forming apparatus including a registration roller that corrects sheet skew feeding.

2. Description of Related Art

Conventionally, in the image forming apparatus that utilizes an electrophotographic system to form the image in the sheet such as a recording sheet, the image is obtained by transferring a toner image (visible image) borne on a photosensitive drum or a transfer body to the sheet such as plain paper conveyed from a sheet cassette. The sheet to which the toner image is transferred from the photosensitive drum or transfer body is conveyed to a fixing device to fix the toner image onto the sheet, and the sheet is discharged.

In cases where the images are formed in both surfaces of the sheet, when the sheet in which the toner image is fixed to one of the surfaces passes through the fixing device, the sheet is tentatively guided to a reverse path, and a reverse roller is reversely rotated to convey the sheet to a both-sided conveying path while a rear end of the sheet is set in the head. Then the toner image is transferred and fixed to the sheet reversed by passing through the both-sided conveying path, and the sheet is discharged.

In the conventional image forming apparatus, sometimes a sheet leading end direction is slightly rotated with respect to the sheet conveying direction, that is, sometimes skew feeding of the sheet is generated during a sheet feeding operation for feeding the sheet from the sheet cassette or during sheet conveyance subsequent to the sheet feeding operation. When the skew feeding of the sheet is generated, the image formed on the sheet through the transfer and fixing processes is inclined with respect to the sheet.

Therefore, in the conventional image forming apparatus, a skew feeding correction portion is provided in the sheet conveying apparatus that conveys the sheet to an image forming portion, and the skew feeding correction portion corrects the skew feeding of the sheet to improve accuracy of image forming position.

For example, in the skew feeding correction portion, the sheet conveyed by pre-registration rollers (pair) is abutted on a nip of a stopped registration roller to form a loop (deflection), thereby a sheet leading end is aligned with a direction orthogonal to the sheet conveying direction. After the sheet leading end is aligned, the registration roller and the pre-registration roller are driven to deliver the sheet to the image forming portion.

In the conventional image forming apparatus including the skew feeding correction portion, for example, in order to enhance productivity, the pre-registration roller conveys the sheet at a speed higher than a process speed to abut the sheet on the stopped registration roller. After the sheet is abutted on the registration roller to correct the skew feeding, the pre-registration roller is tentatively stopped, and the registration roller and the pre-registration roller are simultaneously driven in synchronization with image timing (see Japanese Patent Application Laid-Open No. 62-244846).

However, with such a configuration, a large hitting sound (collision noise) is generated because the sheet is abutted on the registration roller at high speed, and the hitting sound becomes larger when the sheet conveying speed is further enhanced with recent increasing process speed. When the sheet is abutted on the registration roller at high speed, sometimes the sheet leading end penetrates through registration roller. In such cases, disadvantageously the skew feeding is not corrected or a leading end margin is deviated.

In order to solve the problem, after the sheet is tentatively stopped near the registration roller, only the roller on the upstream is previously driven to abut the sheet on the registration roller at low speed, thereby reducing the hitting sound (see Japanese Patent Application Laid-Open No. 6-127753).

Similarly, after the sheet is tentatively stopped near the registration roller, only the roller on the upstream is previously driven at the process speed, and the registration roller is driven at the process speed, thereby reducing the hitting sound (see Japanese Patent Application Laid-Open No. 10-152244).

However, in the conventional speed-enhanced sheet conveying apparatus and the image forming apparatus provided therewith, in order to enhance the productivity, it is necessary to convey the sheet at a speed faster than the process speed even after the skew feeding is corrected.

Therefore, in the conventional high-speed image forming apparatus, when the skew feeding of the sheet is corrected, a registration roller drive motor (or clutch) that drives the registration roller is tentatively stopped after a registration sensor detects the sheet leading end as illustrated in FIG. 6A. A relay roller drive motor (or clutch) that drives a relay roller located on the upstream of the registration roller is also stopped.

After the rollers are stopped at the same time as the registration sensor that detects the sheet leading end is turned on, the drive of the relay roller is started in predetermined timing faster than a registration roller re-driving signal by a loop forming time, and the relay roller is driven at the process speed, thereby forming the loop. Then the registration roller is driven at the process speed.

For example, as illustrated in FIG. 6B, the high-speed relay roller located on the upstream of the registration roller is tentatively stopped after the registration sensor is turned on by detecting the sheet leading end. The relay roller is driven to form the loop when a predetermined time TA elapses, and the registration roller is driven when a predetermined time TB elapses.

However, in the case of the drive control illustrated in FIGS. 6A and 6B, until the registration roller reaches the process speed after the loop is formed, the excessive loop is formed because the relay roller is driven at the process speed. That is, when the registration roller is started up after the relay roller is previously driven to form the loop, the excessive loop is formed until the registration roller reaches the constant speed, which results in buckling. Particularly the loop amount becomes larger for a short time as the process speed is enhanced due to the speed enhancement of the image forming apparatus. When the large loop space is ensured, the apparatus is enlarged.

When drive coupling is performed with a clutch in order to shorten a time the registration roller reaches the constant speed, because the clutch has a variation in coupling time of about 10 ms, unevenness of the leading end margin is generated depending on the apparatus. The unevenness of the leading end margin becomes severer in the recent high-speed image forming apparatus. For example, in the image forming apparatus having the process speed of 300 mm/s, unevenness of the leading end margin of 3 mm is generated when the coupling time is varied by 10 ms. It is necessary to provide another control unit in order to correct the unevenness of the leading end margin.

In the high-speed image forming apparatus, because the desired loop amount is formed while the pre-registration roller is started up and accelerated, the loop is eliminated between the registration roller and the pre-registration roller when only the registration roller is coupled with the clutch. As a result, step-out of the motor or a fluctuation in sheet conveying speed, caused by tension between the registration roller and the pre-registration roller, is generated to deviate the leading end margin.

The problem is not generated when the whole drive coupling on the upstream of the registration roller is performed with the clutch. However, in such cases, because a clutch coupling sound is simultaneously generated, another noise is generated. Additionally cost is also increased.

In view of the foregoing, an object of the invention is to provide a sheet conveying apparatus and an image forming apparatus, in which the skew feeding of the sheet can securely be corrected while the noise is reduced.

SUMMARY OF THE INVENTION

In accordance with an aspect of the invention, a sheet conveying apparatus in which a sheet is abutted on a stopped registration roller to correct skew feeding of the sheet, the sheet being conveyed by a conveying roller disposed on an upstream in a sheet conveying direction of the registration roller, and the registration roller and the conveying roller are driven after the skew feeding is corrected, the sheet conveying apparatus includes: a sheet detecting portion that is disposed between the registration roller and the conveying roller to detect the sheet conveyed by the conveying roller; a first stepping motor that drives the registration roller; and a second stepping motor that drives the conveying roller; a control unit that controls the conveying roller to stop the sheet based on the detecting of the sheet detecting portion, the conveying roller to be driven prior to the start of the drive of the registration roller, and the registration roller to be driven after a loop of a predetermined amount is formed in the sheet, wherein while the conveying roller forms the loop in the sheet, the control unit controls the conveying roller is driven at a sheet conveying speed that is equal to or lower than a sheet conveying speed by a self-start frequency at which the first stepping motor can be started to rotation, and a rotation of the registration roller and a rotation of the conveying roller are accelerated after the loop of the predetermined amount is formed.

Accordingly, the conveying roller is driven after tentatively stopped, and the sheet is abutted on the stopped registration roller to deflect the sheet, which allows the noise to be reduced. After the sheet is deflected by the predetermined amount, the registration roller and the conveying roller are simultaneously driven while accelerated with the same acceleration, which allows the skew feeding of the sheet to be securely corrected.

Further features of the present invention will become apparent from the following description of exemplary embodiments (with reference to the attached drawings).

DESCRIPTION OF THE EMBODIMENTS

An exemplary embodiment of the invention will be described in detail with reference to the drawings.

Figure 1:
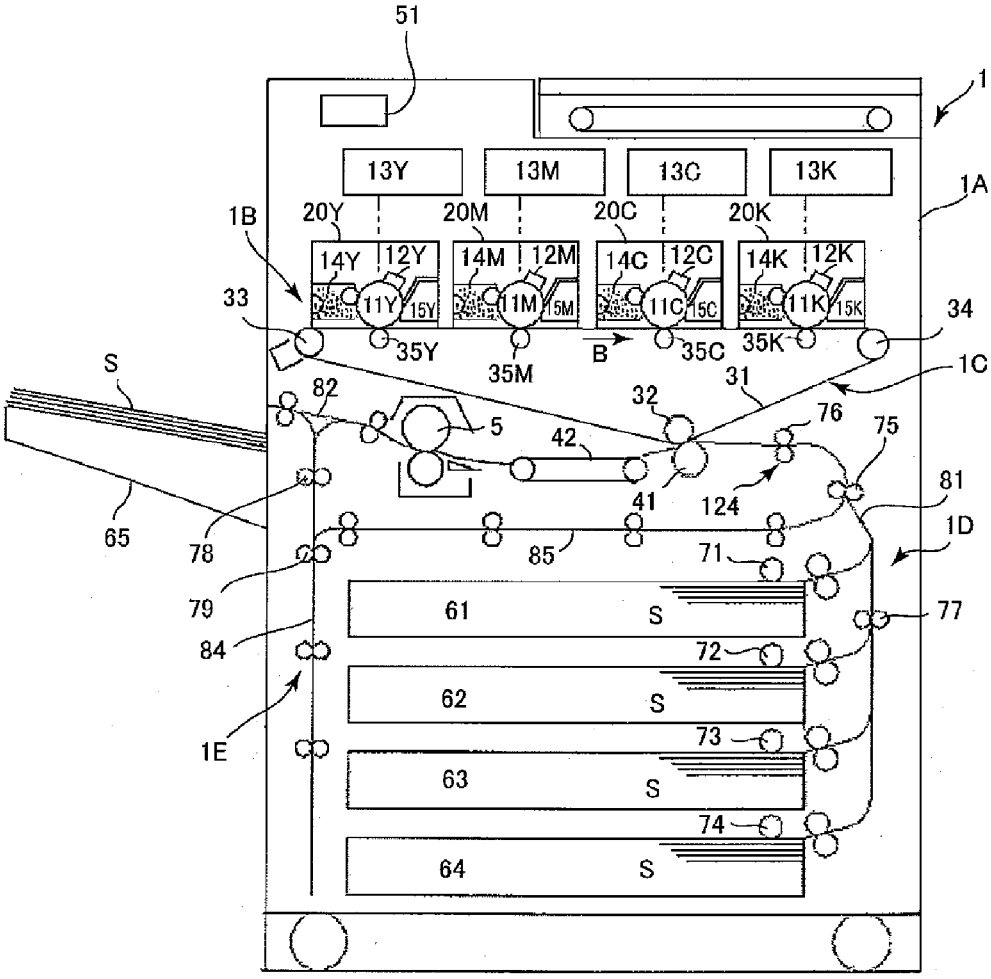
FIG. 1 illustrates a schematic configuration of a color laser printer that is of an example of an image forming apparatus including a sheet conveying apparatus according to an embodiment of the invention.

FIG. 1 illustrates a schematic configuration of a color laser printer that is of an example of an image forming apparatus including a sheet conveying apparatus according to an embodiment of the invention.

In a color laser printer 1 of FIG. 1, an image forming portion 1B that forms an image on a sheet S, an intermediate transfer portion 1C, a sheet feeding portion 1D that feeds the sheet S to the image forming portion 1B, and a fixing device 5 are provided in a color laser printer main body (hereinafter referred to as printer body) 1A. Because the color laser printer 1 can also form the image on the backside of the sheet, a re-conveying portion 1E is provided to reverse the sheet S in which the image is formed on the surface (one surface) to convey the sheet S to the image forming portion 1B.

The image forming portion 1B is disposed in a substantially horizontal direction, and the image forming portion 1B includes four process stations 20 (20Y, 20M, 20C, and 20K) that form toner images of four colors, that is, yellow (Y), magenta (M), cyan (C), and black (K).

The process stations 20 include photosensitive drums 11 (11Y, 11M, 11C, and 11K) that are of image bearing bodies. The photosensitive drums 11 (11Y, 11M, 11C, and 11K) are driven by stepping motors (not illustrated) while bearing the yellow, magenta, cyan, and black toner images. The process stations 20 also include charging devices 12 (12Y, 12M, 12C, and 12K) that evenly charge surfaces of the photosensitive drums.

The process stations 20 include scanners 13 (13Y, 13M, 13C, and 13K) that irradiate the photosensitive drums with laser beams based on image information to form electrostatic latent images on the photosensitive drums rotated at constant speed. The process stations 20 include development devices 14 (14Y, 14M, 14C, and 14K) that visualize the electrostatic latent images as the toner images by causing yellow, magenta, cyan, and black toners to adhere to the electrostatic latent images formed on the photosensitive drums. The charging device 12, the scanner 13, and the development device 14 are disposed along the rotating direction of the photosensitive drum 11.

The sheet feeding portion 1D is provided below the printer body, and the sheet feeding portion 1D includes sheet cassettes 61 to 64 in which the sheets S are stored and pickup rollers 71 to 74 that deliver the sheets S stacked and stored in the sheet cassettes 61 to 64.

When an image forming operation is started, the sheets S are separated and delivered one by one from the sheet cassettes 61 to 64 by the pickup rollers 71 to 74. Then the sheet S passes through a conveying longitudinal path 81, and the sheet S is conveyed to a registration roller 76 through a pre-registration roller 75. The registration roller 76 has a function, in which a loop is formed by abutting the sheet S on the registration roller 76, thereby causing a leading end of the sheet S to follow the registration roller 76 to correct the skew feeding. The registration roller 76 also has a function of conveying the sheet S to a secondary transfer portion at a time the image is formed on the sheet S, that is, in synchronization with the toner image borne on an intermediate transfer belt.

The registration roller 76 is stopped while the pre-registration roller 75 conveys the sheet S, and a deflection of the sheet S is formed by abutting the sheet S on the stopped registration roller 76. Then the sheet leading end follows a nip of the registration roller 76 by rigidity of the sheet S, thereby correcting the skew feeding of the sheet S. When the skew feeding of the sheet S is corrected, the registration roller 76 is driven at the time the toner image formed on an intermediate transfer belt 31 is matched with the leading end of the sheet S as described later.

The intermediate transfer portion 1C includes the intermediate transfer belt 31. As illustrated by an arrow, the intermediate transfer belt 31 is rotated along the direction in which the process stations 20 are arrayed in synchronization with an outer circumferential speed of the photosensitive drum 11. The intermediate transfer belt 31 is tensioned by a drive roller 33, a driven roller 32, and a tension roller 34. The driven roller 32 forms a secondary transfer region while the intermediate transfer belt 31 is sandwiched. The tension roller 34 gives a proper tension to the intermediate transfer belt 31 by a biasing force of a spring (not illustrated).

Four primary transfer rollers 35 (35Y, 35M, 35C, and 35K) constituting a primary transfer portion are disposed inside the intermediate transfer belt 31. The intermediate transfer belt 31 is sandwiched by each of the primary transfer rollers 35 and the photosensitive drum 11. The primary transfer rollers 35 are connected to a transfer bias power supply (not illustrated). The transfer biases are applied from the primary transfer rollers 35 to the intermediate transfer belt 31, the color toner images on the photosensitive drums are sequentially multiply-transferred to the intermediate transfer belt 31, and a full-color image is formed on the intermediate transfer belt 31.

A secondary transfer roller 41 is disposed so as to face the driven roller 34. The secondary transfer roller 41 is abutted on the lowermost surface of the intermediate transfer belt 31, and the secondary transfer roller 41 conveys the sheet S conveyed by the registration roller 76 and the intermediate transfer belt 31 while sandwiching the sheet S and the intermediate transfer belt 31 between the secondary transfer roller 41 and the driven roller 34. When the sheet S passes through the nip portion between the secondary transfer roller 41 and the intermediate transfer belt 31, the bias is applied to the secondary transfer roller 41 to secondary-transfer the toner image on the intermediate transfer belt 31 to the sheet S.

The fixing device 5 fixes the toner image formed on the sheet S via the intermediate transfer belt 31 onto the sheet S. When the sheet S on which the toner image is formed passes through the fixing device 5, the toner image is fixed to the sheet S by applying heat and pressure. A control unit 51 controls an operation necessary for the image formation of the printer body 1A.

An image forming operation of the color laser printer 1 will be described below.

When the image forming operation is started, in the process station 20Y located on the upstream in the rotating direction of the intermediate transfer belt 31, the scanner 13Y irradiates the photosensitive drum 11Y with the laser beam to form a yellow latent image on the photosensitive drum. Then the development device 14Y develops the latent image using yellow toner to form the yellow toner image.

In the primary transfer region, the yellow toner image formed on the photosensitive drum 11Y is primary-transferred to the intermediate transfer belt 31 by the primary transfer roller 35Y to which a high voltage is applied. Then the toner image is conveyed to the primary transfer region of the next process station 20M along with the intermediate transfer belt 31. The primary transfer region of the next process station 20M includes the photosensitive drum 11M and the primary transfer roller 35M. In the primary transfer region of the next process station 20M, the image is formed while being behind the process station 20Y by the time the toner image is conveyed.

The next magenta toner image is transferred to the intermediate transfer belt while the leading end of the magenta toner image is matched with that of the yellow toner image on the intermediate transfer belt. The similar process is repeated, and therefore the four-color toner image is primary-transferred onto the intermediate transfer belt 31 to form the full-color image on the intermediate transfer belt. The transfer residual toner slightly left on the photosensitive drum is recovered by photosensitive body cleaners 15 (15Y, 15M, 15C, and 15K), and the next image formation is performed.

In parallel with the toner image forming operation, the sheets S stored in the sheet cassettes 61 to 64 are separated and delivered one by one by the pickup rollers 71 to 74, and the sheet S is conveyed to the registration roller 76 through the pre-registration roller 75.

At this point, the registration roller 76 is stopped, and the sheet S is abutted on the stopped registration roller 76 to correct the skew feeding of the sheet S. After the skew feeding is corrected, the registration roller 76 conveys the sheet S to the nip portion between the secondary transfer roller 41 and the intermediate transfer belt 31. The registration roller 76 starts the rotation at the time the sheet leading end is matched with the toner image formed on the intermediate transfer belt 31.

The sheet S is conveyed while sandwiched between the secondary transfer roller 41 and the intermediate transfer belt 31. When the sheet S passes through the nip portion between the secondary transfer roller 41 and the intermediate transfer belt 31, the toner image on the intermediate transfer belt is secondary-transferred to the sheet S by the bias applied to the secondary transfer roller 41.

A pre-fixing conveying device 42 conveys the sheet S to which the toner image is secondary-transferred to the fixing device 5. The fixing device 5 melts and fixes the toner image onto the sheet S by applying a predetermined pressing force of the facing roller or belt and a heating effect of a heat source such as a heater.

A sheet-discharge conveying path 82 is selected when the sheet S to which the toner image is fixed is discharged to a sheet discharge tray 65, and a reverse guide path 83 is selected when the both-sided image formation is performed. When the images are formed on both surfaces, the sheet S is retracted from the reverse guide path 83 to a switchback path 84, the leading end and rear end of the sheet S is switched by performing a switchback operation in which a pair of second reverse rollers 79 is normally and reversely rotated, and the sheet S is conveyed to a both-sided conveying path 85.

Then the sheet S re-joins together in synchronization with the subsequent sheet S conveyed from the pickup rollers 71 to 74, and the sheet S is delivered to the secondary transfer portion through the registration roller 76. The image forming process performed to the backside (second surface) is similar to that of the surface (first surface).

When the sheet S is reversely discharged, after the sheet S passes through the fixing device 5, the sheet S is retracted from the reverse guide path 83 to the switchback path 84. The retracted sheet S is conveyed in the opposite direction to the delivered direction by the reverse rotation of the pair of first reverse rollers 78 while the rear end of the sheet S is set in the head, and the sheet S is discharged to the sheet discharge tray 65.

Referring to FIG. 1, a sheet conveying apparatus 124 conveys the sheet S fed from the sheet feeding portion 1D to the image forming portion 1B. The sheet conveying apparatus 124 includes the registration roller 76 and the pre-registration roller 75. The pre-registration roller 75 is a conveying roller that is disposed on the upstream in the sheet conveying direction of the registration roller 76.

FIG. 2 illustrates a configuration of the sheet conveying apparatus 124. As illustrated in FIG. 2, the registration roller 76 is driven by a registration roller drive motor M2 that is of the first stepping motor. The pre-registration roller 75 is driven by a pre-registration roller drive motor M1 that is of the second stepping motor. A registration sensor SN is provided between the registration roller 76 and the pre-registration roller 75. The registration sensor SN is a sheet detecting portion that detects a position of the sheet leading end.

In FIG. 2, an upper guide 90 and a lower guide 91 constitute a sheet conveying pathway R. A registration loop space LS is provided between the registration roller 76 and pre-registration roller 75 of the sheet conveying pathway R. In the registration loop space LS, a loop (deflection) is formed in the sheet S that is conveyed from a manual sheet feeding portion (not illustrated) to the registration roller 76 through a manual sheet conveying pathway R1.

In the embodiment, the registration roller drive motor M2 and pre-registration roller drive motor M1 that are of the stepping motor can control a sheet conveying amount using a pulse amount of the stepping motor. The registration roller drive motor M2 and the pre-registration roller drive motor M1 can freely set a sheet conveying speed, acceleration, and deceleration.

Figure 3:
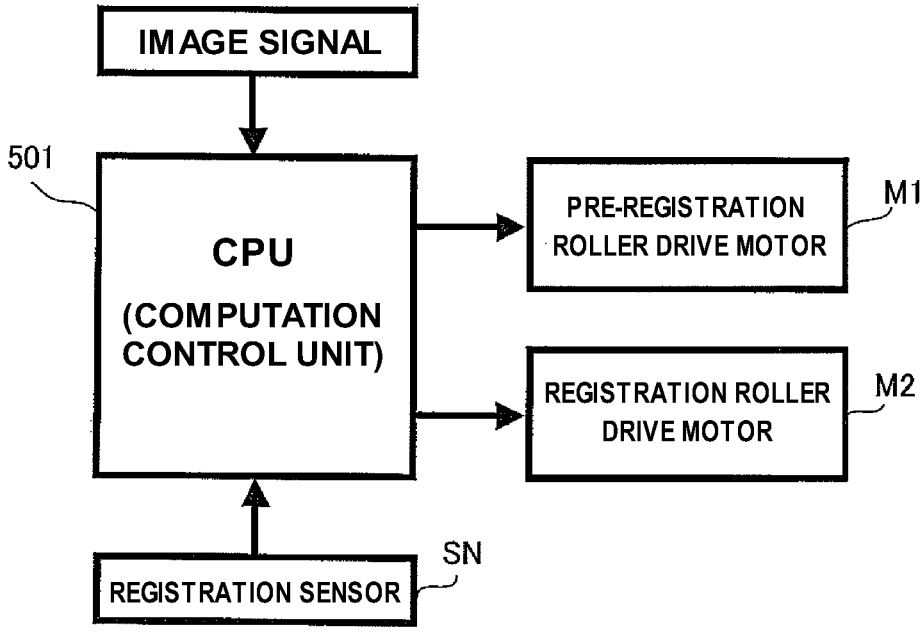
FIG. 3 illustrates a control block diagram of the sheet conveying apparatus.

FIG. 3 illustrates a control block diagram of the sheet conveying apparatus 124. In FIG. 3, a CPU (computation control unit) 501 is provided in the control unit 51. In addition to the image signal, a leading end detecting signal is fed into the CPU 501 from the registration sensor SN. The CPU 501 drives the registration roller drive motor M2 and the pre-registration roller drive motor M1 based on the leading end detecting signal from the registration sensor SN.

Figure 2A:
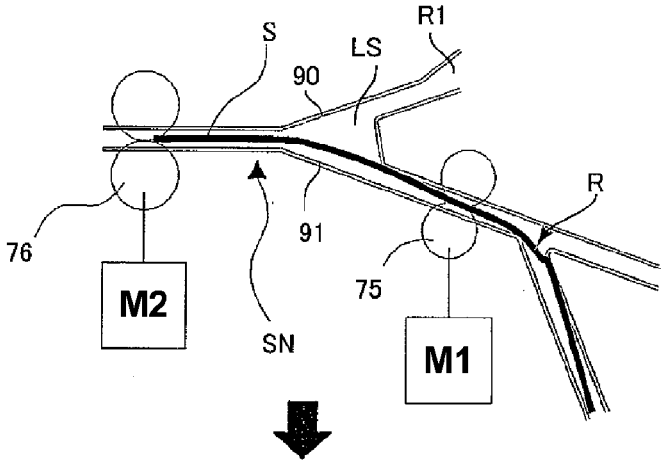
FIG. 2 illustrates a configuration of the sheet conveying apparatus.
Figure 2B:
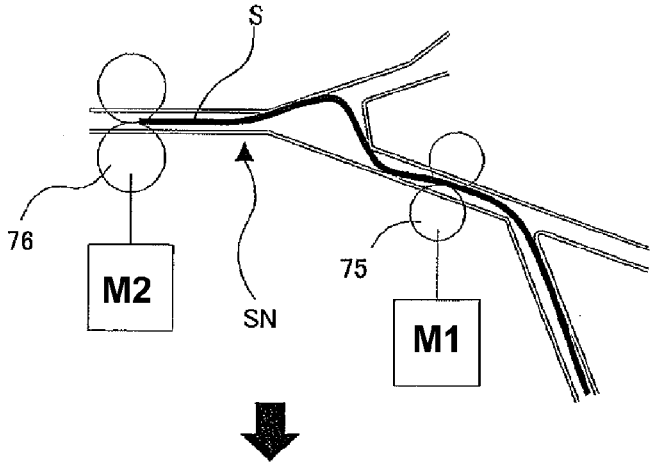

In the embodiment, when the skew feeding is corrected, the sheet is conveyed faster than the process speed by the pre-registration roller 75, and the sheet S is controlled so as to be stopped at a position just before (near) the nip of the registration roller 76 as illustrated in FIG. 2B. Therefore, because the sheet does not hit the registration roller 76, generation of hitting sound can be prevented.

Then, as illustrated in FIG. 2B, the pre-registration roller 75 is driven to form a loop between the registration roller 76 and the pre-registration roller 75, thereby correcting the skew feeding of the sheet S. In producing the loop, the sheet conveying speed of the pre-registration roller 75 is set to the sheet conveying speed of the registration roller 76 or less. The registration roller 76 is rotated according to a self-start frequency (starting frequency) of the registration roller drive motor M2.

When the loop is formed, the registration roller drive motor M2 and the pre-registration roller drive motor M1 are simultaneously accelerated with the same acceleration to start up the pre-registration roller 75 and the registration roller 76.

Figure 4A:
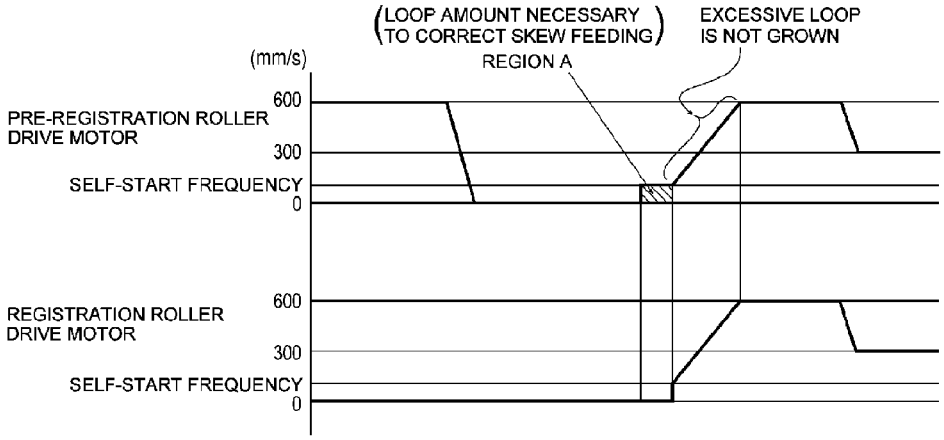
FIG. 4 illustrates a sequence of the sheet conveying apparatus and a conventional sequence.
Figure 4B:
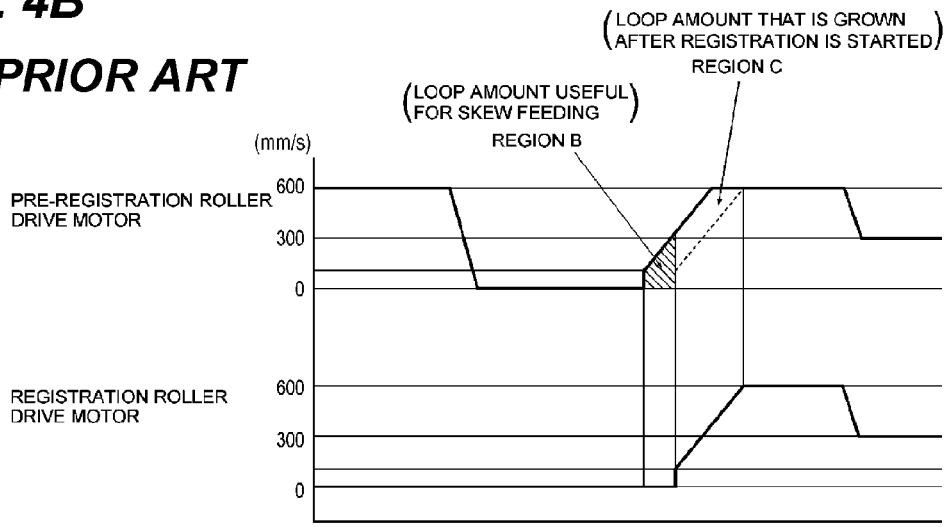
FIG. 4B PRIOR ART

FIG. 4 illustrates a sequence of the embodiment and a conventional sequence. In the conventional sequence, as illustrated in FIG. 4B, the registration roller drive motor M2 is accelerated while the pre-registration roller drive motor M1 is accelerated. In such cases, because a speed difference is generated between the pre-registration roller 75 and the registration roller 76, the loop is grown after a region B corresponding to a loop amount useful for the skew feeding. An area of a region C of FIG. 4B corresponds to the loop amount that is grown after the registration is started.

For example, the desired loop amount is set to 6 mm, the self-start frequency speed is set to 100 mm/sec, the acceleration is set to 10,000 mm/sec$^2$, and the post-acceleration conveying speed is set to 600 mm/sec. Assuming that the acceleration of the registration roller drive motor M2 is started after the loop of 6 mm is formed, the area of the region C is computed to obtain the excessively grown loop amount of about 9.6 mm, and the loop of the total of about 15.6 mm is formed.

At this point, the sheet S is buckled to cause a jam. Even if the jam is not generated, a folding habit is generated at the buckled point in the sheet S, which results in an image defect when the image is transferred in the secondary transfer portion or a jam in the subsequent conveying pathway.

Although the start-up of the registration roller drive motor M2 can be advanced to solve the problems, the conveyance of the sheet S is started while the loop amount is small with respect to the loop space, and therefore the skew feeding correction performance is weakened. On the contrary, the large loop space can be ensured. However, in such cases, the apparatus is enlarged.

In the embodiment, as illustrated in FIG. 4A, during forming the loop, the sheet conveying speed of the pre-registration roller 75 is set equal to or lower than the sheet conveying speed of the registration roller 76 that is driven at the self-start frequency of the registration roller drive motor M2. After the loop amount necessary to correct the skew feeding is formed, the registration roller drive motor M2 and the pre-registration roller drive motor M1 are simultaneously accelerated with the same acceleration.

During forming the loop, the sheet conveying speed of the pre-registration roller 75 is set equal to or lower than the sheet conveying speed of the registration roller 76 that is driven at the self-start frequency of the registration roller drive motor M2. Therefore, the self-start frequency of the pre-registration roller drive motor M1 is set lower than the self-start frequency of the registration roller drive motor M2. However, the productivity is degraded as the sheet conveying speed of the pre-registration roller drive motor M1 is set slower. Accordingly, in consideration of the productivity, during forming the loop, the sheet conveying speed of the pre-registration roller 75 can be set to the sheet conveying speed of the registration roller 76 that is driven at the self-start frequency of the registration roller drive motor M2 or to the neighborhood of the sheet conveying speed of the registration roller 76.

Figure 2C:
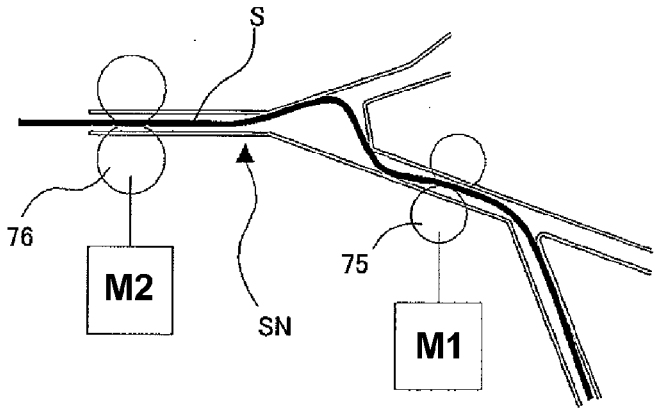

As illustrated in FIG. 2C, the sheet S is conveyed to the secondary transfer portion while the loop amount is kept constant, that is, while the excessive loop is not grown. Therefore, the maximum loop amount is previously formed with respect to the loop space, so that the skew feeding correction performance can maximally exerted even in the compact loop space.

Because the sheet S is abutted on the nip of the registration roller 76 at a speed slower than usual, the hitting sound (collision noise) generated at that time is reduced. Further, because the sheet S is abutted on the nip of the registration roller 76 at a speed slower than usual, the sheet S hardly penetrates through the nip of the registration roller 76 during forming the loop, an alignment defect or unevenness of a leading end margin, caused by the sheet penetration, can be prevented.

Figure 5:
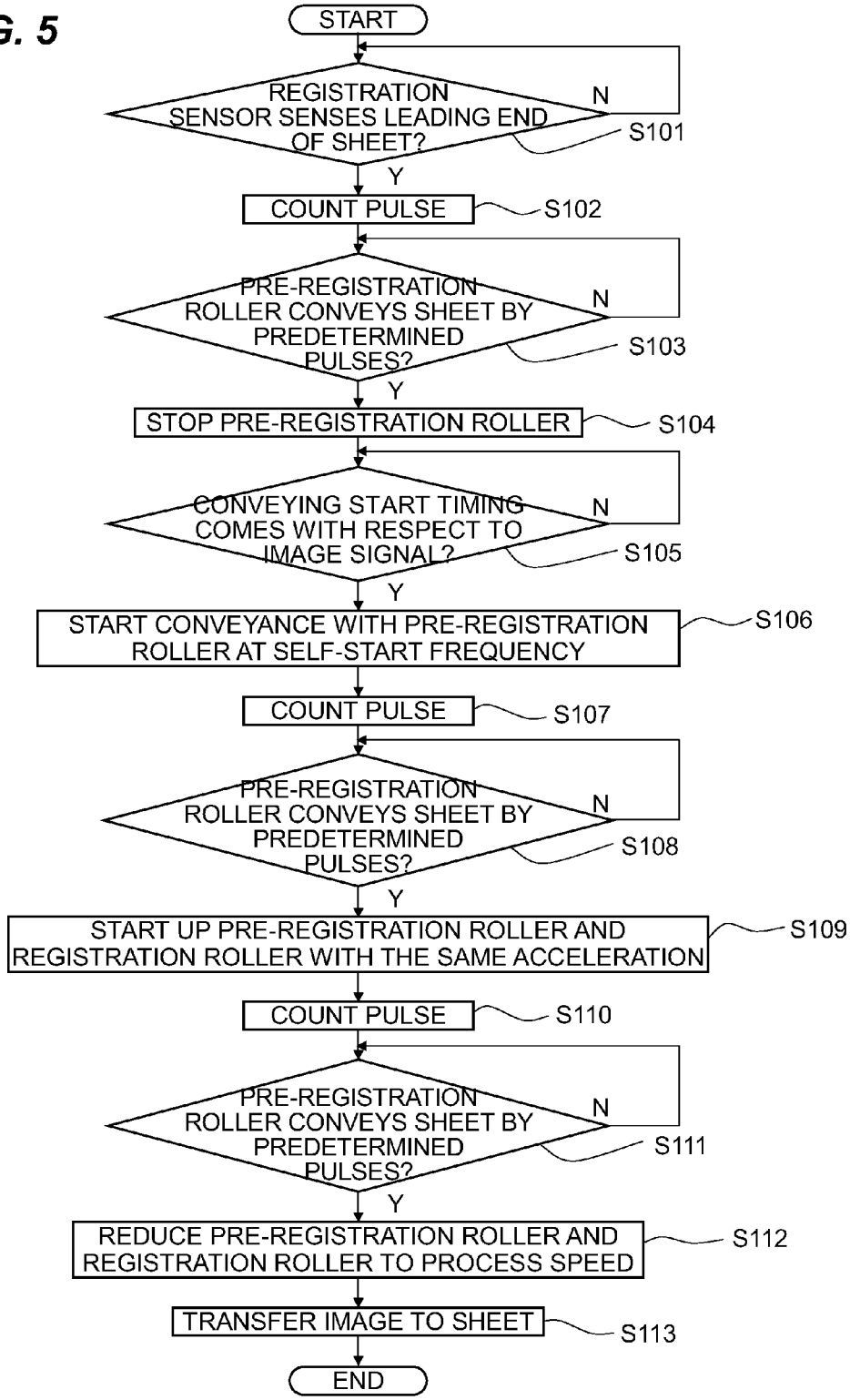
FIG. 5 is a flowchart illustrating a drive sequence of the sheet conveying apparatus.
Figure 6A:
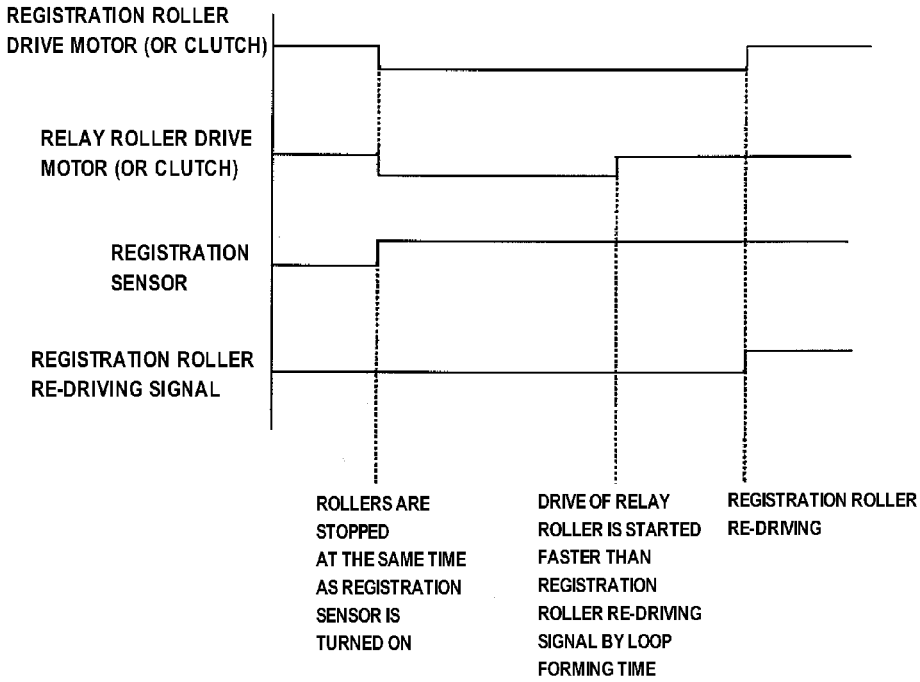
FIG. 6A PRIOR ART
FIG. 6 illustrates a conventional drive sequence during skew feeding correction.
Figure 6B:
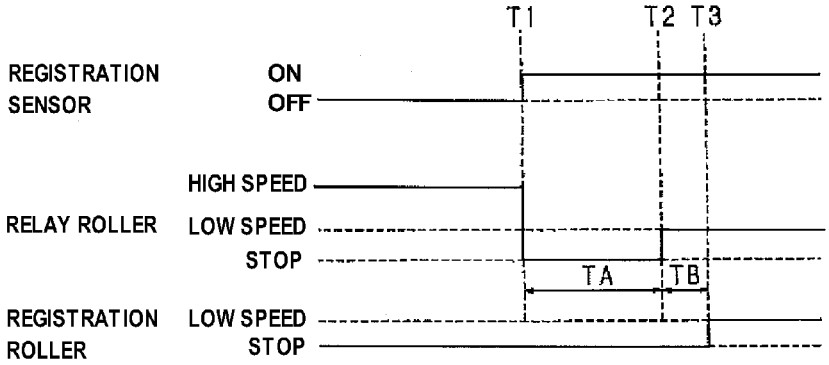
FIG. 6B PRIOR ART

A drive sequence of the sheet conveying apparatus 124 will be described with reference to a flowchart of FIG. 5.

When the color laser printer 1 starts a print job, the full-color image or monochrome image is formed on the intermediate transfer belt 31 by the image forming process. In parallel, the CPU 501 supplies the sheet feeding signal in desired timing with respect to the obtained image signal, one of the sheet cassettes 61 to 64 feeds the sheet S, and the sheet S is conveyed to the pre-registration roller 75.

In the embodiment, the process speed is set to 300 mm/sec, and the sheet conveying speed is set to 600 mm/sec faster than the process speed in order to improve productivity.

The pre-registration roller 75 that receives the sheet S conveys the sheet S at the same speed. When the registration sensor SN detects the sheet leading end (Y in S101), the pre-registration roller drive motor M1 is controlled by pulse management such that the sheet S is stopped just before the nip of the registration roller 76 as illustrated in FIG. 2A. That is, the CPU 501 starts the pulse counting such that the sheet S is stopped just before the nip of the registration roller 76 based on the sheet leading end detecting signal from the registration sensor SN (S102).

A determination whether the number of counted pulses reaches a predetermined pulse number, that is, whether the pre-registration roller 75 conveys the sheet S by predetermined pulses is made (S103). When the pre-registration roller 75 conveys the sheet S by predetermined pulses (Y in S103), the pre-registration roller drive motor M1 is stopped to stop the pre-registration roller 75 (S104). At this point, the sheet S is stopped without forming the loop. Because the sheet S conveyed at high speed is stopped just before the nip of the registration roller 76, the hitting sound against the registration roller 76 is not generated.

A determination whether conveying start timing comes with respect to the image signal is made (S105). When the conveying start timing comes (Y in S105), in order to synchronize the image timing, the pre-registration roller 75 and the registration roller 76 are rotated to start the sheet conveyance. In the embodiment, the pre-registration roller 75 is driven in advance of the start of the drive of the registration roller 76. Therefore, as illustrated in FIG. 2B, the loop is formed between the registration roller 76 and the pre-registration roller 75, and the leading end of the sheet S follows the registration roller 76 to correct the skew feeding of the sheet S.

The loop is formed as large as possible within a range in which the loop is not buckled with respect to the registration loop space LS, and the formed loop amount is managed by the number of pulses of the pre-registration roller drive motor M1. That is, the pulse counting is started since the sheet conveyance is started, and the sheet is conveyed until the number of pulses reaches the predetermined pulse number, thereby forming the loop of the desired (predetermined) loop amount in the sheet.

When the loop amount is formed as large as possible within the range in which the loop is not buckled with respect to the registration loop space LS, a large component force is applied in the direction in which the sheet S is pressed against the registration roller 76, so that skew feeding correction performance is improved.

In forming the loop, the sheet conveying speed of the pre-registration roller 75 is set to a speed at a predetermined self-start frequency, for example, 100 mm/sec that is equal to or lower than the self-start frequency of the registration roller drive motor M2. In the embodiment, when the conveying start timing comes (Y in S105), the CPU 501 controls the registration roller drive motor M2 to rotate the pre-registration roller 75 at the predetermined self-start frequency, thereby starting the sheet conveyance (S106). Therefore, because the sheet S is abutted on the nip of the registration roller 76 at a speed slower than usual, the small amount of hitting sound (collision noise) is generated to reduce rubbing sound generated in forming the loop between the sheet S and the upper and lower guides 90 and 91.

The number of pulses of the pre-registration roller drive motor M1 that drives the pre-registration roller 75 is counted (S107), and a determination whether the number of counted pulses reaches a predetermined pulse number, that is, whether the pre-registration roller 75 conveys the sheet by predetermined pulses is made (S108). When the pre-registration roller 75 conveys the sheet by the predetermined pulses (Y in S108), the registration roller drive motor M2 and the pre-registration roller drive motor M1 are accelerated with the same acceleration. Therefore, the pre-registration roller 75 and the registration roller 76 are started up with the same acceleration (S109).

After the registration roller is driven, the sheet conveying speed is set to 600 mm/sec that is faster than the process speed after the skew feeding correction. Then the predetermined amount is conveyed at the sheet conveying speed of 600 mm/sec, and the number of pulses is counted to determine whether the pre-registration roller 75 conveys the sheet by the predetermined pulses (S111).

When the number of counted pulses reaches a predetermined pulse number, that is, when the pre-registration roller 75 and the registration roller 76 convey the sheet by the predetermined pulses (Y in S111), the pre-registration roller 75 and the registration roller 76 are reduced to the process speed in synchronization with the image timing (S112). The sheet is conveyed at the process speed to the secondary transfer portion to transfer the image to the sheet (S113).

As illustrated in FIG. 2C, the sheet S is conveyed to the secondary transfer portion while the loop amount is kept constant, that is, the excessive loop is not grown. Therefore, the maximum loop amount can previously be formed with respect to the loop space, and the skew feeding performance can maximally be exerted even in the compact loop space.

In the embodiment, the pre-registration roller 75 is previously driven at constant speed after the sheet is tentatively stopped near the registration roller, and the registration roller 76 and the pre-registration roller 75 are simultaneously driven while accelerated with the same acceleration after the loop is formed. Therefore, the hitting sound and the noise generated in forming the loop can be reduced. Further, the alignment defect or the unevenness of the leading end margin, caused by sheet penetration, a conveyance defect such as buckling caused by the excessive loop, and an image defect caused by the conveyance defect can be prevented.

The pre-registration roller 75 is driven after the pre-registration roller 75 is tentatively stopped, and the sheet is deflected by abutting the sheet on the stopped registration roller 76, which allows the noise to be reduced. After the sheet is deflected by the predetermined amount, the registration roller 76 and the pre-registration roller 75 are simultaneously driven while accelerated with the same acceleration after the acceleration is started, which allows the skew feeding of the sheet to be securely corrected. Therefore, a color laser printer (image forming apparatus) that may achieve the high productivity can be provided.

Depending on a sheet size, sometimes the registration roller 76 and a relay roller such as the longitudinal path roller 77 of FIG. 1 simultaneously convey the same sheet S. The relay roller is disposed on the upstream in the sheet conveying direction of the pre-registration roller 75. In such cases, when the registration roller 76 and the pre-registration roller 75 convey the sheet after the loop is formed, the longitudinal path roller 77 is controlled like the pre-registration roller 75 so as not to become a load on the sheet conveyance.

That is, when the registration sensor SN detects the sheet, after the longitudinal path roller 77 that can convey the same sheet along with the registration roller 76 is tentatively stopped, the longitudinal path roller 77 and the pre-registration roller 75 are driven at constant speed. After the sheet is deflected by the predetermined amount, the longitudinal path roller 77, the registration roller 76, and the pre-registration roller 75 are simultaneously driven while accelerated with the same acceleration.

Alternatively, after the sheet is deflected by the predetermined amount, a one-way clutch may be disposed in a drive line of the longitudinal path roller 77 such that the registration roller 76, the pre-registration roller 75, and the longitudinal path roller 77 are simultaneously driven while accelerated with the same acceleration. Therefore, because the sheet S is conveyed under the control of the pre-registration roller 75, the equal effect is obtained. In cases where the images are formed both sides of the sheet S, the similar sequence is used as the drive sequence of the sheet conveying apparatus. Therefore, the equal effect is obtained.

In the embodiment, the sheet is stopped near the registration roller. However, the invention is not limited to the embodiment, but the sheet may be stopped while the sheet leading end slightly reaches the nip of the registration roller 76.

In such cases, when the registration sensor SN detects the sheet, the pre-registration roller drive motor M1 is decelerated, and the sheet S is controlled so as to reach the nip of the registration roller 76 immediately before the pre-registration roller drive motor M1 is stopped. When the sheet is decelerated and tentatively stopped, because the sheet S is abutted on the nip of the registration roller 76 at a low speed, the hitting sound is reduced.

In the embodiment, the control of the sheet conveying apparatus conveys the sheet to the image forming portion 1B by way of example. The invention may be applied to a sheet conveying apparatus that conveys an original in an automatic original conveying apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-285470 filed Nov. 6, 2008, which is hereby incorporated by reference herein in its entirety.

What is claimed is:

1. A sheet conveying apparatus in which a sheet is abutted on a stopped registration roller to correct skew feeding of the sheet, the sheet being conveyed by a conveying roller disposed upstream in a sheet conveying direction of the registration roller, and the registration roller and the conveying roller are driven after the skew feeding is corrected, the sheet conveying apparatus comprising:

a sheet detecting portion that is disposed between the registration roller and the conveying roller to detect the sheet conveyed by the conveying roller;

a first stepping motor that drives the registration roller;

a second stepping motor that drives the conveying roller; and a control unit that controls the second stepping motor so that the conveying roller stops the sheet at a position before the registration roller or at an abutted position on the registration roller based on the detecting of the sheet detecting portion, and the conveying roller starts to convey the sheet at a sheet conveying speed that is equal to or lower than a sheet conveying speed by a self-start frequency of the first stepping motor, to form a loop of a predetermined amount in the sheet, and the control unit controls the first and second stepping motors so that a rotation of the registration roller and a rotation of the conveying roller are started up with predetermined identical accelerations at the same time after the loop of the predetermined amount is formed.

2. The sheet conveying apparatus according to claim 1, wherein rotation of the second stepping motor is controlled at a speed that is equal to or lower than a sheet conveying speed of the registration roller, the registration roller being driven by the rotation of the first stepping motor according to the self-start frequency.

3. The sheet conveying apparatus according to claim 1, comprising a relay roller that can convey the sheet along with the registration roller, the relay roller being located on the upstream in the sheet conveying direction of the conveying roller, wherein, in cases where the relay roller and the registration roller simultaneously convey the sheet, when the sheet detecting portion detects the sheet, the conveying roller and the relay roller are driven at a constant speed after being tentatively stopped, and the registration roller, the conveying roller, and the relay roller are simultaneously driven while being accelerated with identical acceleration after the sheet is deflected by a predetermined amount.

4. The sheet conveying apparatus according to claim 1, comprising a relay roller that can convey the sheet along with the registration roller, the relay roller being located on the upstream in the sheet conveying direction of the conveying roller, wherein the relay roller includes a one-way clutch such that the registration roller and the conveying roller are simultaneously driven while being accelerated with identical accelerations after the sheet is deflected by a predetermined amount.

5. An image forming apparatus in which a sheet is abutted on a stopped registration roller to correct skew feeding of the sheet, the sheet being conveyed by a conveying roller disposed upstream in a sheet conveying direction of the registration roller, the registration roller and the conveying roller are driven to convey the sheet to an image forming portion after the skew feeding is corrected, and an image is formed on the sheet in the image forming portion, the image forming apparatus comprising:

a sheet detecting portion that is disposed between the registration roller and the conveying roller to detect the sheet conveyed by the conveying roller;

a first stepping motor that drives the registration roller;

a second stepping motor that drives the conveying roller; and a control unit that controls the second stepping motor so that the conveying roller stops the sheet at a position before the registration roller or at an abutted position on the registration roller, based on the detecting of the sheet detecting portion, and the conveying roller starts to convey the sheet at a sheet conveying speed that is equal to or lower than a sheet conveying speed by a self-start frequency of the first stepping motor, to form a loop of a predetermined amount in the sheet, and the control unit controls the first and second stepping motors so that a rotation of the registration roller and a rotation of the conveying roller are started up with predetermined identical accelerations at the same time after the loop of the predetermined amount is formed.

6. The image forming apparatus according to claim 5, wherein rotation of the second stepping motor is controlled at a speed that is equal to or lower than a sheet conveying speed of the registration roller, the registration roller being driven by the rotation of the first stepping motor according to the self-start frequency.

7. The image forming apparatus according to claim 5, comprising a relay roller that can convey the sheet along with the registration roller, the relay roller being located on the upstream in the sheet conveying direction of the conveying roller, wherein, in cases where the relay roller and the registration roller simultaneously convey the sheet, when the sheet detecting portion detects the sheet, the conveying roller and the relay roller are driven at a constant speed after being tentatively stopped, and the registration roller, the conveying roller, and the relay roller are simultaneously driven while being accelerated with identical accelerations after the sheet is deflected by a predetermined amount.

8. The image forming apparatus according to claim 5, comprising a relay roller that can convey the sheet along with the registration roller, the relay roller being located on the upstream in the sheet conveying direction of the conveying roller, wherein the relay roller includes a one-way clutch such that the registration roller and the conveying roller are simultaneously driven while being accelerated with identical accelerations after the sheet is deflected by a predetermined amount.

9. The image forming apparatus according to claim 5, wherein the sheet conveying speed is enhanced faster than a process speed of the image forming portion before the conveying roller is tentatively stopped and after the registration roller is driven, and the sheet conveying speed is reduced to the process speed before the image is formed on the sheet.

* * * * *